US005950610A

United States Patent [19]

Troncoso

[11] Patent Number: 5,950,610

[45] Date of Patent: Sep. 14, 1999

[54] ARROW REST MOUNTING BAR ASSEMBLY

[76] Inventor: Robert Troncoso, 14090-6100 Rd., Montrose, Colo. 81401

[21] Appl. No.: 09/263,460

[22] Filed: Mar. 5, 1999

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 4,476,846 | 10/1984 | Carville | 124/44.5 |
| 4,827,895 | 5/1989 | Troncoso | 124/44.5 |
| 4,947,823 | 8/1990 | Larson | 124/44.5 |
| 5,070,855 | 12/1991 | Troncoso | 124/44.5 |
| 5,213,090 | 5/1993 | Tone | 124/44.5 |
| 5,482,025 | 1/1996 | Finkel | 124/44.5 |
| 5,490,491 | 2/1996 | Troncoso | 124/44.5 |

*Primary Examiner*—John A. Ricci
*Attorney, Agent, or Firm*—Donald E. Nist

[57] ABSTRACT

The improved arrow rest mounting bar assembly includes an elongated mounting bar, the front portion of which defines a transverse opening for securing the bar to the riser of an archery bow, with the rear portion of the bar extending behind the riser. The bar front portion includes a number of vertical openings spaced along the length thereof and extending up from the bottom thereof. The rear portion of the bar has a pair of spaced rearwardly extending arms defining a collar-receiving space therebetween, in which is disposed a rotatable collar. The collar and arms define aligned apertures therethrough for receiving the transverse cross bar of an arrow rest. The collar has a first lock screw with expanded head external thereof, the shaft of the lock screw extending through the collar into the collar aperture for locking the collar to the cross bar. The collar is cylindrical with its opposite sides abutting the inner bearing surfaces of the arms. The first lock screw is secured to the rear end of an elongated coiled tensioning spring, the front end of which is secured to a second lock screw releasably secured in a preselected one of the vertical openings in the underside of the front portion of the bar, so that the tension of the spring can be adjusted. The rear portion of the bar is dimensioned such that upward rotation of the collar is limited by the head of the first lock screw to provide the rest with a preselected resting position.

5 Claims, 1 Drawing Sheet

ARROW REST MOUNTING BAR ASSEMBLY

BACKGROUND OF THE INVENTION

1. Field of the Invention

The present invention generally relates to archery arrow rest mounting means and more particularly to an improved type of mounting system for an archery arrow rest.

2. Prior Art

Modern arrow rests for archery bows conventionally comprise one or a plurality of launcher arms which hold the shaft of an archery arrow. The launcher arms project up into the arrow window of the archery bow from a transverse cross bar connected to the rear end of the arms. The cross bar is connected behind the bow riser to the rear end of a mounting bracket by a series of narrow couplings on opposite sides of the mounting bracket. The launcher arms may be spring tensioned by having a spring connected to the mounting bracket and cross bar by a separate connector.

The described archery arrow rest mounting means have several disadvantages. Thus, when it is desired to adjust the position of the launcher arms either horizontally or vertically, at least two separate sets of couplings must be loosened and then retightened to the cross bar. This also may involve having to move the spring connector. All this takes time and makes it difficult to reposition the launcher arms.

Moreover, the couplings and spring connector can easily work loose during shooting of the bow due to the jarring action of the bowstring on the bow components when the bowstring is released during shooting. Shooting accuracy is thereby seriously affected as the launcher arms shift position during sequential shooting, changing the point of aim.

In addition, conventional arrow rest support means do not provide a way of changing the degree of spring tension imparted to the launcher arms without changing the spring itself.

Accordingly, there is a need for an improved type of arrow rest mounting assembly, which assembly prevents shifting of the arrow launcher arm or arms during repeated shooting of the bow, and which mounting assembly can be easily manipulated to adjust both the vertical and horizontal positions of the launcher arm or arms. The mounting assembly should be simple and inexpensive to make and simple to use. Moreover, it should be durable in use. In addition, it should provide for easy and simple adjustment of the amount of tension provided by the mounting assembly spring.

SUMMARY OF THE PRESENT INVENTION

The improved archery arrow rest mounting bar assembly of the present invention satisfies all the foregoing needs. The assembly is simple to make and use, is durable and is inexpensive. It provides improved shooting accuracy and adjustability when used in conjunction with an arrow rest having a transverse cross bar which carries one or a pair of launcher arms or the like.

It will be understood that by launcher arm is meant a metal, plastic or other type of arrow shaft support means disposed on an arm or as part of an arm projecting into the arrow window of the bow from the rear of the window behind which the cross bar is positioned, with the rear portion of the arm secured to the cross bar.

The arrow rest mounting assembly of the present invention includes an elongated mounting bar, the front portion of which has a transverse opening through which a screw, bolt or the like can be passed to secure the front portion of the bar to the side of an arrow riser in the area adjacent the arrow window.

The rear portion of the bar has an unique configuration in that it is bifurcated to provide a laterally spaced pair of rearwardly extending arms postioned on opposite sides of the longitudinal axis of the bar. The inner surfaces of the arms are flat and provide alignment means for a cylindrical collar slideably disposed thereagainst in the space between the arms.

The collar and arms define aligned transverse apertures extending theerethrough through which the cross bar of an archery arrow rest extends. The cross bar is releasably locked to the collar by a first threaded screw, bolt or the like having an expanded head, the shaft of the screw extending through the collar into contact with the aperture therein and into contact with the cross bar when in the collar.

The assembly preferably also includes an elongated coiled spring or the like, the rear end of which is releasably secured to the first screw. The main body of the spring extends along the exterior at the bottom of the mounting bar and the front of the spring is releasably connected to a second threaded screw releasably secured in any one of a plurality of vertical openings spaced along the length of the front portion of the mounting bar and extending up from the bottom thereof. Thus, the relative tension exerted by the spring can be changed by repositioning the second screw in a different one of the mounting bar openings.

When it is desired to connect the mounting bar assembly to an arrow rest, the cross bar of the rest is passed through the apertures in the collar and rear arms of the mounting bar, the front portion of the mounting bar is fixed in place to the bow riser, as by a bolt or the like, the transverse and vertical positions of the launcher arms of the rest are adjusted by sliding and turning the rest cross bar, and then the first lock screw is tightened to hold the rest securely in place. The spring can then be attached to the first lock screw and to the second lock screw and the entire assembly is ready for use. If desired, the spring can be dispensed with, in which event the second screw and the screw holes in the front portion of the mounting bar can also be be dispensed with.

The arrow rest position will not shift during use of the rest because the single collar is relatively wide and is fully aligned with the bearing surfaces of the mounting bar arms. Any readjustment of the arrow rest arms can be simply and easily be made merely by loosening the first lock screw, turning and sliding the rest cross bar and retightening the first lock screw, all without removing or adjusting the spring.

Moreover, the mounting bar assembly has a built-in resting position for the arrow rest launcher arms, in that the head of the first lock screw prevents upward spring biased movement of the collar beyond a predetermined position, due to the head of the first lock screw striking the surface of the rear portion of the mounting bar in the area defining the collar space.

The mounting bar assembly can be made inexpensively of plastic, hardened rubber, metal, either cast or machined, or other suitable durable material, or a combination of such materials, and can be made in any suitable size and configuration consistent with the description set forth above. The assembly has no protruding components which would interfere with either the appearance or use of the assembly on an archery bow.

Various other features of the present invention are set forth in the following detailed description and accompanying drawings.

DRAWINGS OF THE PREFERRED EMBODIMENT

DETAILED DESCRIPTION OF THE PREFERRED EMBODIMENT

Figure 1:
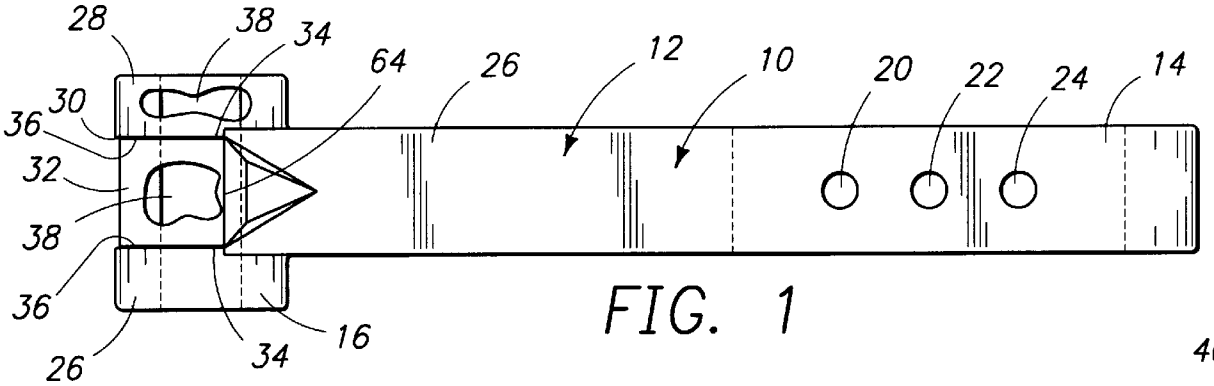
FIG. 1 is an enlarged schematic bottom plan view, partly broken away, of a preferred embodiment of the improved archery arrow rest mounting bar assembly of the present invention, the spring and screws thereof not being shown.
Figure 2:
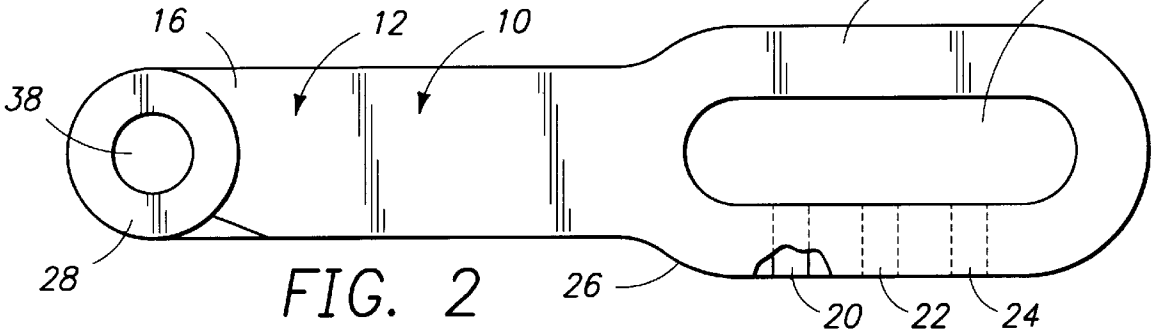
FIG. 2 is an enlarged schematic side elevation, partly broken away, of the assembly of FIG. 1, the spring and screws thereof not being shown.
Figure 3:
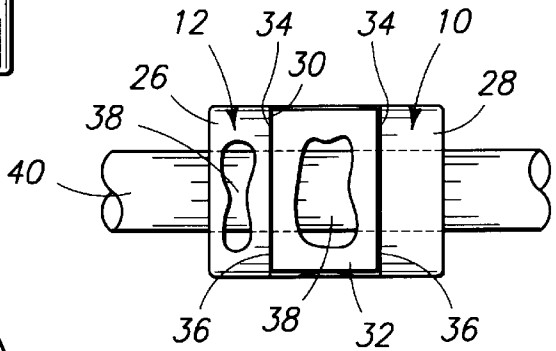
FIG. 3 is an enlarged schematic rear elevation, partly broken away, of the assembly of FIG. 1, showing the cross bar of an arrow rest in place therein, the spring and screws thereof not being shown.

FIGS. 1–5:

Now referring to FIGS. 1–5, the preferred embodiment of the improved assembly of the present invention is schematically depicted therein. Thus, assembly 10 is shown, which comprises an elongated relatively flat mounting bar 12 having a front portion 14 and an opposite rear portion 16.

Front portion 14 includes an elongated opening or slot 18 through which a bolt or the like (not shown) can be passed to releasably connect front portion 14 to the sidewall of an archery bow riser (not shown) in the area adjacent the arrow window (not shown) of the bow. Front portion 14 also includes a plurality, in this instance three, threaded openings 20, 22 and 24 spaced along the length of front portion 14 and extending vertically up from the bottom 26 of front portion 14.

Rear portion 16 is adapted to extend behind the bow riser and is bifurcated, that is, comprises a pair of laterally spaced rearwardly extending arms 26 and 28 disposed on opposite sides of the longitudinal axis of bar 12 and defining therebetween a central stop collar-receiving space 30 within which is disposed a cylindrical collar 32, the opposite ends 34 of which slidingly abut the inner flat surfaces 36 of arms 26 and 28, so that collar 32 is accurately positioned in space 30. Collar 32 and arms 26 and 28 include aligned transverse apertures 38 extending through the centers thereof.

Openings 38 are adapted to slidingly receive the transverse cross bar 40 of arrow rest 42 (FIGS. 3–5), which is releasably secured in position by a first lock screw 44 having a threaded shaft 46 passing through a threaded opening (not shown) in collar 32 and into contact with aperture 38 thereof and cross bar 40 therein. Lock screw 44 has an expanded head 48.

Cross bar 40, when connected to assembly 10 and when assembly 10 is connected to the riser of the archery bow (not shown), extends to a position behind the arrow window of the bow and is connected to the rear ends of a spaced pair of arrow rest launcher arms 50 and 52 (FIGS. 4 and 5) projecting forwardly and upwardly from cross bar 40 into the arrow window. The relative horizontal and vertical positions of the arms 50 and 52 are controlled through cross bar 40, collar 32 and lock screw 44.

Assembly 10 preferably also includes an elongated spring 54, preferably a coiled spring, the rear end 56 of which is releasably connected to screw 44, the main body 58 of which extends below bottom 26 of mounting bar 12 and the front end 60 of which is releasably connected to a second threaded lock screw 62 releasably secured in a preselected one of threaded openings 20, 22 and 24, thus controlling the relative tension exerted by spring 54 on collar 32 to bias its rotation and provide resilient resistance of launcher arms 50 and 52 to downward pressure encountered when a arrow is launched therefrom during shooting of the bow.

Figure 4:
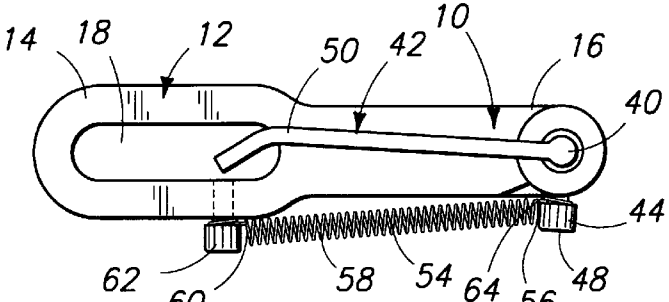
FIG. 4 is a schematic side elevation of the assembly of FIG. 1, shown with the spring and screws thereof and shown with the assembly connected to an arrow rest; and, FIG. 5 is a schematic rear elevation, partly broken away, of the assembly of FIG. 1, shown with the spring and first lock screw in view and with the assembly connected to the arrow rest of FIG. 4.
Figure 5:
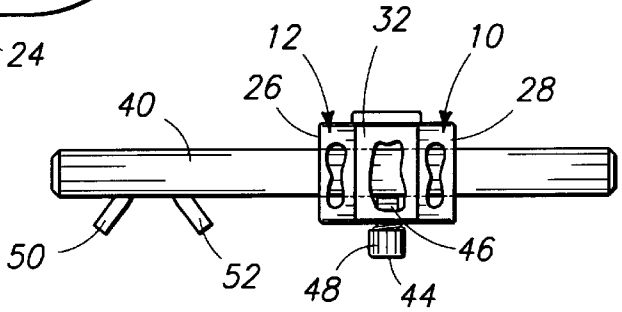

Head 48 of lock screw 44 limits the upward rotation of launcher arms 50 and 52 to a predetermined resting position because head 48 during such rotation strikes the surface of rear portion 16 at the point 64 indicated in FIGS. 1 and 4, preventing collar 32 from rotating further under the bias of spring 54.

Accordingly, screw 44 has the multiple function of acting as a rotation limiting means to position launcher arms 50 and 52 into a resting position, and also acts as an anchor for spring 54, as well as the single means for loosening and tightening, and thus repositioning, cross bar 40 to control the orientation of launcher arms 50 and 52. Because collar 32 is relatively wide and is positively and securely positioned in space 30 against surfaces 36 of arms 26 and 28, slippage of cross bar 40 and launcher arms 50 and 52 is prevented, so that more accurate stable shooting of arrows from the bow is achieved. Other features of the improved assembly of the present invention are as set forth in the foregoing.

It will be understood that spring 54, lock screw 62 and openings 20,22 and 24 could be eliminated, if desired. However, assembly 10 preferably includes these components.

Various other modifications, changes, alterations and additions can be made in the improved assembly of the present invention, its components and parameters. All such modifications, changes, alterations and additions as are within the scope of the appended claims form part of the present invention.

What is claimed is:

1. An improved arrow rest mounting bar assembly, said assembly comprising, in combination:

a) an elongated mounting bar having a front portion and an opposite rear portion, a top and a bottom, i. said front portion including securing means for mounting said assembly to the riser portion of an archery bow with said rear portion extending behind said riser, said front portion also including retaining means for mounting thereon spring means for tensioning an arrow rest when said arrow rest is connected to said rear portion of said mounting bar, ii. said rear portion of said mounting bar including a pair of rearwardly extending arms spaced parallel to each other on opposite sides of the longitudinal axis of said mounting bar, each said arm having a flat inner bearing surface, said arms defining a collar-receiving space therebetween, said arms also defining transversely extending apertures extending therethrough aligned with each other and adapted to receive the cross bar of an arrow rest;

b) a single stop collar slideably received within said space between said arms, abutting said inner bearing surfaces and defining an aperture extending transversely therethrough, aligned with said arm apertures and adapted to receive said cross bar of an arrow rest; and, c) connector means extending from an opening in the outer surface of said stop collar into said collar aperture for releasably locking said cross bar of said arrow rest in any desired transverse and vertical orientation relative to said mounting bar.

2. The improved arrow rest mounting bar assembly of claim 1 wherein said collar connector means comprises a first lock screw extending through said collar aperture, wherein said assembly also includes an elongated spring having a rear end and an opposite front end, said spring rear end being connected to said first lock screw and wherein said retaining means comprises a second lock screw secured to said bar and to said front end of said spring.

3. The improved arrow rest mounting bar assembly of claim 2 wherein said securing means in said front portion of said mounting bar comprises a transverse opening through said bar and wherein said second lock screw is releasably secured in a preselected one of a plurality of vertical apertures spaced along said bar front portion, whereby the tension exerted by said spring is adjustable by selectively positioning said second lock screw in a desired one of said vertical apertures.

4. The improved arrow rest mounting bar assembly of claim 3 wherein said spring is a coiled spring extending longitudinally of said bar adjacent the exterior surface at the bottom of said bar and wherein said first and second lock screws are releasably secured to the bottom of said bar and include expanded heads, said first lock screw having the double function of holding said spring and of releasably and securely locking the transverse bar of an arrow rest in a desired orientation through said collar.

5. The improved arrow rest mounting bar assembly of claim 4 wherein said rear portion of said bar is dimensioned such that upward rotation of said collar and transverse bar of said arrow rest against said spring tension is limited by contact of said head of said first lock screw with said rear portion of said bar to provide said rest with a preselected resting position.

* * * * *